US011300137B2

(12) United States Patent
Uchino et al.

(10) Patent No.: US 11,300,137 B2
(45) Date of Patent: Apr. 12, 2022

(54) CENTRIFUGAL FAN

(71) Applicant: Nidec Corporation, Kyoto (JP)

(72) Inventors: Takashi Uchino, Kyoto (JP); Yukinobu Shiraishi, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 30 days.

(21) Appl. No.: 17/015,755

(22) Filed: Sep. 9, 2020

(65) Prior Publication Data

US 2021/0095693 A1 Apr. 1, 2021

(30) Foreign Application Priority Data

Sep. 26, 2019 (JP) ..... JP2019-176155

(51) Int. Cl.
*F04D 29/42* (2006.01)
*F04D 25/06* (2006.01)
*F04D 29/28* (2006.01)

(52) U.S. Cl.
CPC ..... *F04D 29/4226* (2013.01); *F04D 25/0693* (2013.01); *F04D 29/281* (2013.01)

(58) Field of Classification Search
CPC ..... F04D 29/4226; F04D 29/281; F04D 25/0693; F04D 25/08
See application file for complete search history.

(56) References Cited

U.S. PATENT DOCUMENTS 6,551,074 B2 * 4/2003 Kudo ..... F04D 25/0613 417/354
7,207,774 B2 * 4/2007 Kashiwazaki ..... F04D 29/4226 415/203
2014/0010682 A1 * 1/2014 Suzuki ..... F04D 29/403 417/354
2017/0030378 A1 * 2/2017 Fujimoto ..... F04D 29/281
2018/0112677 A1 4/2018 Kominami et al.
2018/0252222 A1 * 9/2018 Yamasaki ..... F04D 25/08

* cited by examiner

*Primary Examiner* — Ninh H. Nguyen
(74) *Attorney, Agent, or Firm* — Keating & Bennett

(57) ABSTRACT

A centrifugal fan includes an impeller including blades, a motor, a housing, and a resin section. The blades are arranged in the circumferential direction about a central axis extending in the vertical direction. The rotor of the motor is rotatable with the blades about the central axis. The housing includes a plate-shaped bottom plate that extends in the radial direction from the central axis, and a housing protrusion that protrudes upward from the upper surface of the bottom plate and extends in the circumferential direction. A housing recess, which is recessed downward, is located in the upper surface of the bottom plate. The resin section includes a resin filled portion filled in the housing recess, and a resin protrusion that is disposed below the blades, protrudes upward from the resin filled portion, and extends in the circumferential direction.

10 Claims, 3 Drawing Sheets

【Fig. 1】
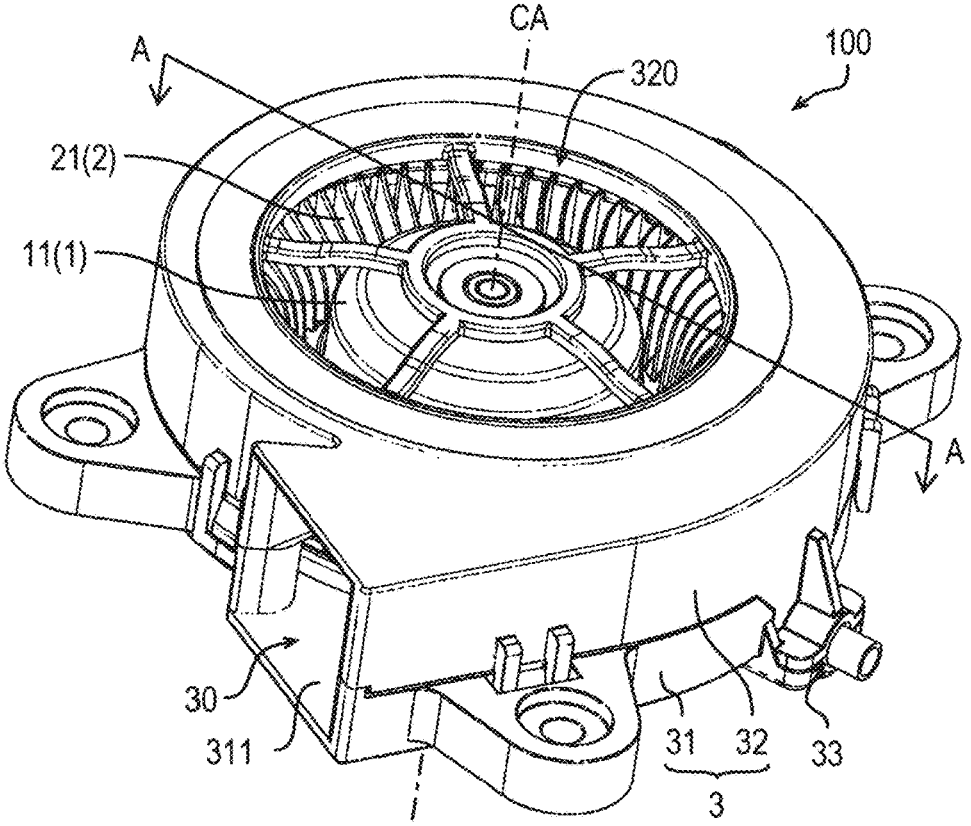
【Fig. 2】
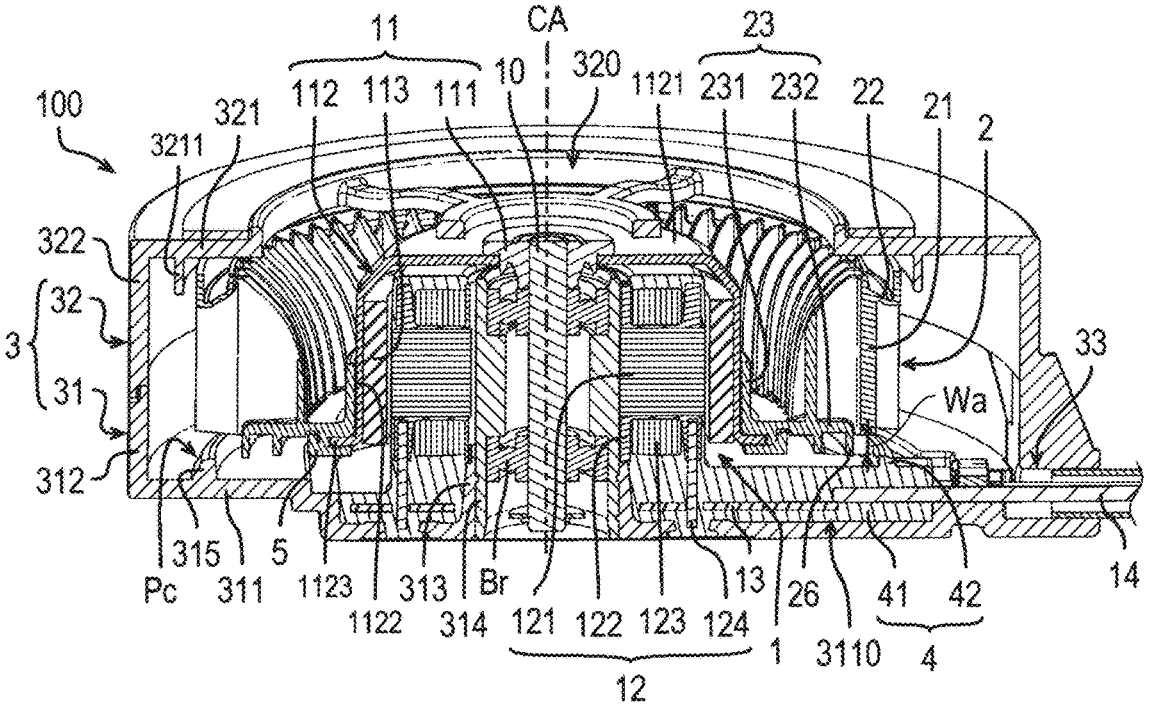

【Fig. 3】
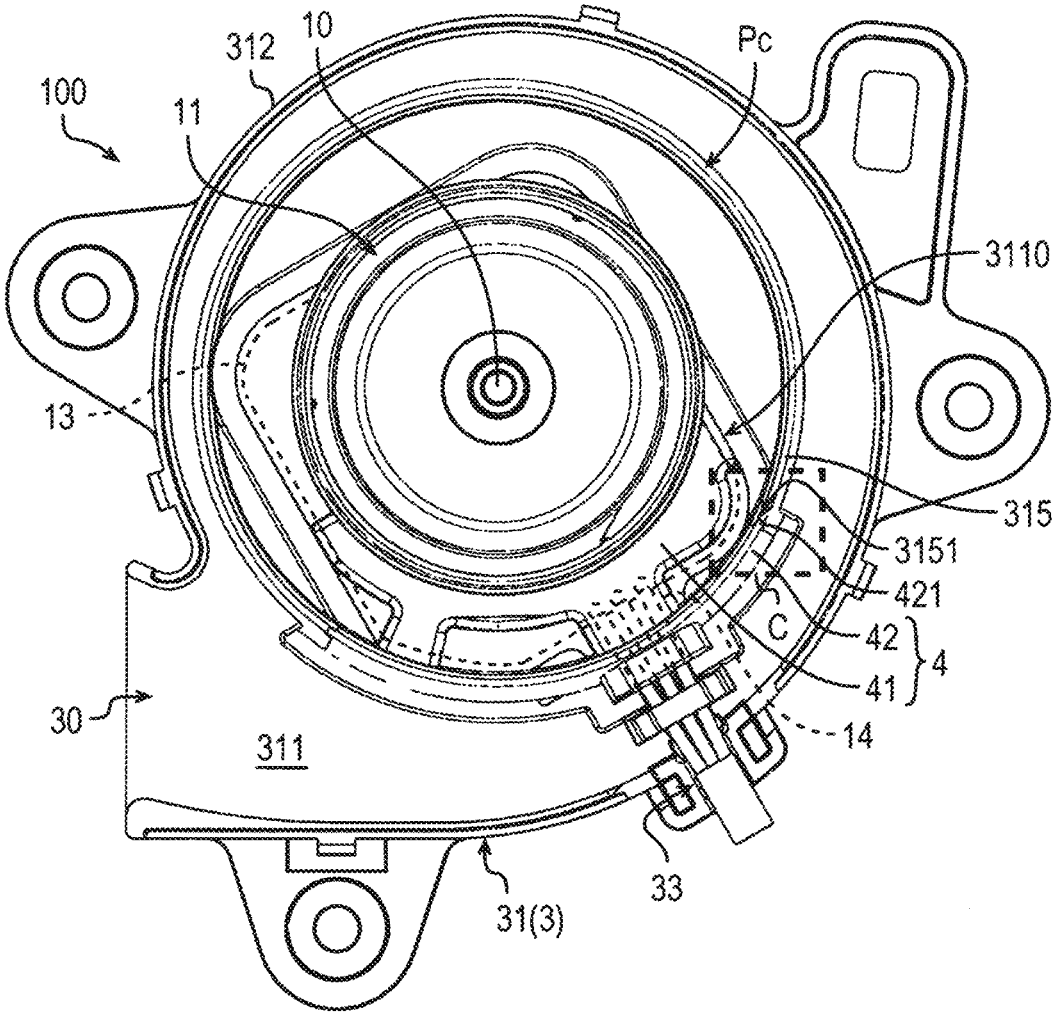

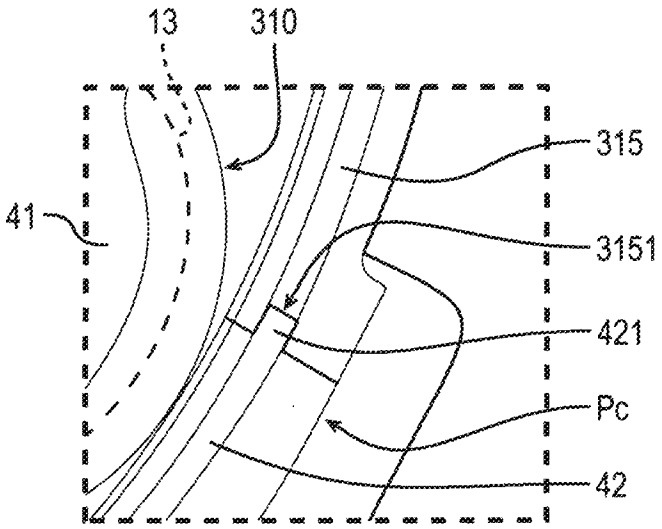
【Fig. 4】

CENTRIFUGAL FAN

CROSS REFERENCE TO RELATED APPLICATION

The present application claims priority under 35 U.S.C. § 119 to Japanese Application No. 2019-176155 filed on Sep. 26, 2019 the entire contents of which are hereby incorporated herein by reference.

FIELD OF THE INVENTION

The present disclosure relates to a centrifugal fan.

BACKGROUND

A conventional centrifugal fan delivers air, which is sucked from above, radially outward by the rotation of an impeller having a plurality of blades.

In the conventional centrifugal fan, a predetermined clearance is provided between the lower ends of the blades and a housing in the axial direction parallel to the rotation axis of the impeller. Therefore, there is a possibility that, below and radially outward of the blades, turbulence may occur in the airflow delivered radially outward from the blades. Such turbulence affects the blowing efficiency of the centrifugal fan.

SUMMARY

A centrifugal fan according to an example embodiment of the present disclosure includes an impeller including a plurality of blades, a motor including a rotor to which the impeller is attached, a housing that houses the impeller and the motor and holds the motor, and a resin section. The plurality of blades is arranged in a circumferential direction about a central axis extending in the vertical direction. The rotor is rotatable with the plurality of blades about the central axis. The housing includes a plate-shaped bottom plate radially extending from the central axis, and a housing protrusion that is disposed below the blades, protrudes upward from the upper surface of the bottom plate, and extends in the circumferential direction. A housing recess, which is recessed downward, is located in the upper surface of the bottom plate. The resin section includes a resin filled portion filled in the housing recess, and a resin protrusion that is disposed below the blades, protrudes upward from the resin filled portion, and extends in the circumferential direction.

The above and other elements, features, steps, characteristics and advantages of the present disclosure will become more apparent from the following detailed description of the example embodiments with reference to the attached drawings.

BRIEF DESCRIPTION OF THE DRAWINGS

FIG. 1 is a perspective view of a centrifugal fan.

FIG. 2 is a sectional view of the centrifugal fan as viewed in the radial direction.

FIG. 3 is a top view of the centrifugal fan as viewed in the axial direction.

FIG. 4 is a view showing a vicinity of a portion of a flow regulating protrusion.

DETAILED DESCRIPTION

Example embodiments of the present disclosure will be described with reference to the drawings. In the present specification, in a centrifugal fan 100, a direction parallel to a central axis CA is referred to as the term "axial direction", "axial", or "axially". In the axial direction, the direction from a substrate 13 to a stator core 121 is referred to as the term "upper" or "upward", and the direction from the stator core 121 to the substrate 13 is referred to as the term "lower" or "downward". In each component, an upper side end is referred to as the term "upper end" and a lower side end is referred to as the term "lower end". Further, on the surface of each component, the surface facing upward is referred to as the term "upper surface", and the surface facing downward is referred to as the term "lower surface".

The direction orthogonal to the central axis CA is referred to as the term "radial direction", "radial", or "radially". In the radial direction, the direction toward the central axis CA is referred to as the term "radially inward", and the direction away from the central axis CA is referred to as the term "radially outward". In each component, a radially inward end is referred to as the term "radially inner end", and a radially outward end is referred to as the term "radially outer end". In addition, regarding side surfaces of each component, a side surface directed in the radial direction is referred to as the term "radial side surface". Further, the side surface directed radially inward is referred to as the term "radially inner side surface", and the side surface directed radially outward is referred to as the term "radially outer side surface".

The direction of rotation about the central axis CA is referred to as the term "circumferential direction", "circumferential", or "circumferentially. In each component, an end in the circumferential direction is referred to as the term "circumferential end". One side in the circumferential direction is referred to as the term "one circumferential side", and the other side in the circumferential direction is referred to as the term "other circumferential side". Further, one end on one circumferential side is referred to as the term "one circumferential end", and the other end on the other circumferential side is referred to as the term "other circumferential end". In addition, regarding side surfaces of each component, a side surface directed in the circumferential direction is referred to as the term "circumferential side surface". Further, the side surface directed to one circumferential side is referred to as the term "one circumferential side surface", and the side surface directed to the other circumferential side is referred to as the term "other circumferential side surface".

In the present specification, the term "annular" indicates a shape that is continuous without having any discontinuous portions over the entire circumference in the circumferential direction about the central axis CA, unless otherwise specified. The term "annular" also includes a shape having a closed curve on a curved surface that intersects with the central axis CA with the central axis CA as the center.

In the positional relationship between any one of the azimuth, line, and plane and another one of them, the term "parallel" indicates not only a state in which they do not intersect at any point but also a state in which they are substantially parallel. The terms "vertical" and "orthogonal" indicate not only a state in which they intersect at 90 degrees with each other, but also a state in which they are substantially vertical and a state in which they are substantially orthogonal. That is, the terms "parallel", "vertical", and "orthogonal" each include a state in which the positional relationship between them has an angular deviation that does not depart from the gist of the present disclosure.

The matters described above are not strictly applied when incorporated in an actual device.

FIG. 1 is a perspective view of the centrifugal fan 100. FIG. 2 is a sectional view of the centrifugal fan 100 as viewed in the radial direction. FIG. 3 is a top view of the centrifugal fan 100 as viewed in the axial direction. Note that FIG. 2 is a sectional view taken along a line A-A in FIG. 1 and shows a cross-sectional structure of the centrifugal fan 100 when the centrifugal fan 100 is cut along a virtual plane parallel to the central axis CA extending in the vertical direction. In FIG. 3, a second housing 32 and an impeller 2 are not shown for clarity.

The centrifugal fan 100 is a blower device that sucks air through an intake port 320 and discharges an airflow from a discharge port 30. As shown in FIG. 2, the centrifugal fan 100 includes a motor 1, an impeller 2 having a plurality of blades 21, a housing 3, a resin section 4, and a ring member 5.

The configuration of the motor 1 will be described with reference to FIGS. 1 to 3. The motor 1 is a drive device that rotationally drives the impeller 2. As shown in FIG. 2, the motor 1 has a shaft 10, a rotor 11, a stator 12, a substrate 13, and a lead wire 14. In other words, the centrifugal fan 100 includes the shaft 10, the rotor 11, the stator 12, the substrate 13, and the lead wire 14.

The shaft 10 is a rotation axis of the rotor 11, supports the rotor 11, and is rotatable with the rotor 11 about the central axis CA. The shaft 10 is not limited to the example in the example embodiment, and may be a fixed shaft attached to the stator 12. If the shaft 10 is a fixed shaft, a bearing (not shown) is disposed between the rotor 11 and the shaft 10.

The rotor 11 is rotatable with a plurality of blades 21 about the central axis CA that extends in the vertical direction. As described above, the motor 1 has the rotor 11. The impeller 2 is attached to the rotor 11. As shown in FIG. 2, the rotor 11 has a shaft housing 111, a rotor holder 112, and a magnet 113.

The shaft housing 111 is attached to the upper part of the shaft 10 and extends in the radial direction from the peripheral surface of the shaft 10.

The rotor holder 112 is a magnetic body. The rotor holder 112 has a rotor lid 1121, a rotor cylindrical part 1122, and a flange 1123. The rotor lid 1121 extends radially outward from a radially outer surface of the shaft housing 111. The rotor cylindrical part 1122 has a cylindrical shape extending in the axial direction. The rotor cylindrical part 1122 extends at least downward from the radially outer end of the rotor lid 1121. The flange 1123 extends radially outward from the lower end of the rotor cylindrical part 1122.

The magnet 113 is held on the radially inner side surface of the rotor cylindrical part 1122. The magnet 113 has a cylindrical shape surrounding the central axis CA and extends in the axial direction. The magnet 113 is located radially outside the stator 12 and faces the radially outer surface of the stator 12 in the radial direction. The magnet 113 is, for example, a rare earth sintered magnet such as a ferrite rubber magnet or a neodymium sintered magnet, and has a plurality of magnetic poles different from each other, that is, N poles and S poles. The N poles and S poles are arranged alternately in the circumferential direction.

The stator 12 has an annular shape centered on the central axis CA and is held by the housing 3. The stator 12 supports the rotor 11, and drives and rotates the rotor 11 when the motor 1 is driven. The stator 12 includes a stator core 121, an insulator 122, a plurality of coils 123, and a wire-wrapped pin 124.

The stator core 121 surrounds the central axis CA that extends in the vertical direction. The stator core 121 is a magnetic body, and is a laminated body obtained by a plurality of electromagnetic steel plates laminated in the axial direction in the present example embodiment.

The insulator 122 covers a portion of the stator core 121. The insulator 122 is formed of a material having electrical insulation such as synthetic resin, enamel, and rubber.

Each coil 123 is formed by winding a conductive wire (not denoted by a reference numeral) around the stator core 121 via the insulator 122. When a drive current is supplied to each coil 123, the stator 12 is excited and drives the rotor 11. The conductive wire is, for example, a metal wire covered with an insulating material, such as an enamel-coated copper wire. The end of the conductive wire is wound around the wire-wrapped pin 124, and is electrically connected to the substrate 13 via the wire-wrapped pin 124.

The wire-wrapped pin 124 extends downward from the insulator 122 in the lower portion of the stator 12. The wire-wrapped pin 124 is made of metal, for example, and is connected to the substrate 13.

The substrate 13 is disposed below the stator 12 and equipped with a drive circuit and the like. The wire-wrapped pin 124 and the lead wire 14 are electrically connected to the substrate 13. The lead wire 14 is a connection wire drawn from the inside of the housing 3 to the outside through a lead port 33. The lead wire 14 electrically connects the substrate 13 that drives the motor 1 and a device such as an external power source outside the housing 3.

The configuration of the impeller 2 will be described with reference to FIGS. 1 and 2. The impeller 2 is driven by the motor 1 to rotate about the central axis CA. Thus, the air sucked through the intake port 320 is delivered radially outward as an airflow. The delivered airflow flows in the housing 3 in the circumferential direction, and is discharged to the outside of the housing 3 through the discharge port 30. As shown in FIG. 2, the impeller 2 further includes a bracket 22, an impeller base 23, and a lower wall 26 in addition to the plurality of blades 21.

The plurality of blades 21 is arranged in the circumferential direction about the central axis CA extending in the vertical direction. Each blade 21 extends in a direction including at least radial direction, out of the radial direction and the circumferential direction, and also extends in the axial direction.

The bracket 22 has an annular shape centered on the central axis CA. The upper ends of the blades 21 are connected to the bracket 22.

The impeller base 23 has an annular shape centered on the central axis CA. As described above, the impeller 2 further includes the impeller base 23. The impeller base 23 has a base cylindrical part 231 and a base annular part 232. The base cylindrical part 231 has a cylindrical shape extending in the axial direction. The rotor cylindrical part 1122 is fitted inside the base cylindrical part 231. The base annular part 232 has an annular shape centered on the central axis CA and extends radially outward from the lower end of the base cylindrical part 231. The radially inner end of the base annular part 232 is in contact with the upper surface of the flange 1123. The lower ends of the blades 21 are connected to the radially outer end of the base annular part 232. In other words, the lower ends of the blades 21 are connected to the upper surface of the impeller base 23.

The lower wall 26 protrudes downward and extends in the circumferential direction. The lower wall 26 is provided on the lower surface of the impeller base 23. In the present example embodiment, the lower wall 26 protrudes downward from the lower surface of the base annular part 232 and extends in the circumferential direction.

The housing 3 will be described with reference to FIGS. 1 to 3. The housing 3 houses the motor 1 and the impeller 2 and holds the motor 1. The intake port 320 is formed in the upper surface of the housing 3. The discharge port 30 and the lead port 33 are formed in the radial side surface of the housing 3. The housing 3 has a first housing 31 and a second housing 32.

The first housing 31 includes a bottom plate 311, a first side wall 312, a housing cylindrical part 313, a bearing housing 314, and a housing protrusion 315. In other words, the housing 3 includes the bottom plate 311, the first side wall 312, the housing cylindrical part 313, the bearing housing 314, and the housing protrusion 315.

The bottom plate 311 has a plate shape extended in the radial direction. As described above, the housing 3 has the bottom plate 311. The bottom plate 311 is provided with an opening (not denoted by a reference numeral) surrounding the central axis CA, a housing recess 3110, and a flow regulating protrusion Pc. In other words, the first housing 31 of the housing 3 further has the opening, the housing recess 3110, and the flow regulating protrusion Pc. These elements will be described later.

The first side wall 312 protrudes upward from the radially outer end of the bottom plate 311, and extends in the circumferential direction. In the present example embodiment, the upper end of the first side wall 312 contacts the lower end of the second housing 32. Thus, a space for housing the motor 1 and the impeller 2 is formed inside the first housing 31 and the second housing 32. Further, a lower part of the discharge port 30 is formed in the first side wall 312. The first housing 31 of the housing 3 is not limited to the example in the present example embodiment, and may not have the first side wall 312. In this case, the lower end of the second housing 32 contacts the upper surface or radially outer end of the bottom plate 311. Furthermore, the discharge port 30 is formed in a later-described second side wall 322 of the second housing 32.

The housing cylindrical part 313 has a cylindrical shape extending in the axial direction, and protrudes upward from the radially inner end of the bottom plate 311 along the opening.

The bearing housing 314 has a cylindrical shape extending in the axial direction, and rotatably supports the shaft 10 via a bearing Br. The lower part of the bearing housing 314 is located inside the housing cylindrical part 313. The housing cylindrical part 313 holds the bearing housing 314, and therefore the motor 1 is supported by the first housing 31. In the present example embodiment, the bearing housing 314 is integrally molded with at least the housing cylindrical part 313. However, the present disclosure is not limited to the example in the example embodiment, and they may not be integrally molded. For example, the lower part of the bearing housing 314 may be fitted into the housing cylindrical part 313. The stator core 121 is fixed to the radially outer surface of the bearing housing 314.

The housing protrusion 315 is formed on the upper surface of the bottom plate 311. The housing protrusion 315 is a part of the flow regulating protrusion Pc. The housing protrusion 315 is disposed below the blades 21, protrudes upward from the upper surface of the bottom plate 311, and extends in the circumferential direction. As described above, the housing 3 has the housing protrusion 315. Due to the housing protrusion 315, air sucked from above is efficiently discharged in the circumferential direction along the housing protrusion 315. Therefore, the blowing efficiency of the centrifugal fan 100 can be further improved.

The housing protrusion 315 is preferably formed near the lower end of any one of the blades 21 in the radial direction. More preferably, the radially inner end of the housing protrusion 315 is located at the same position as the radially outer end of the lower end of any one of the blades 21 in the radial direction, or is located radially inward of the radially outer end of the lower end of any one of the blades 21. In this more preferable configuration, it is more preferable that the radially outer end of the housing protrusion 315 is located at the same position as the radially outer end of the base annular part 232 in the radial direction, or is located radially outward of the radially outer end of the base annular part 232. Due to the housing protrusion 315 being provided near the lower end of any one of the blades 21, the airflow can be smoothly delivered radially outward and downward from the blade 21.

The housing recess 3110 is formed in the upper surface of the bottom plate 311. The housing recess 3110 is recessed downward from the upper surface of the bottom plate 311. The substrate 13 and the end of the lead wire 14 on the substrate 13 side are housed in the housing recess 3110.

The second housing 32 has the intake port 320, a top plate 321, and a second side wall 322.

The top plate 321 has a plate shape extended in the radial direction. The intake port 320 that surrounds the central axis CA is formed in the top plate 321. Further, the top plate 321 has a housing wall 3211. The housing wall 3211 protrudes downward from the lower surface of the top plate 321, and extends in the circumferential direction. In the present example embodiment, the housing wall 3211 is disposed radially outward of the blades 21 and faces the blades 21 in the radial direction. The housing wall 3211 is disposed near the upper ends of the blades 21, so that it is possible to prevent the airflow from returning back to the intake port 320 from above and from radially outward of the blades 21. Note that, preferably, the housing wall 3211 has a closed curve shape when viewed in the axial direction. With this configuration, the housing wall 3211 continuously extends without any discontinuous portions over the entire circumference in the circumferential direction, and whereby the effect of suppressing the airflow from returning back to the intake port 320 can be further improved.

The second side wall 322 protrudes downward from the radially outer end of the top plate 321, and extends in the circumferential direction. In the present example embodiment, the lower end of the second side wall 322 contacts the upper end of the first side wall 312 of the first housing 31. Further, an upper part of the discharge port 30 is formed in the second side wall 322. Note that the second housing 32 is not limited to the example in the present example embodiment, and may not have the second side wall 322. In this case, the upper end of the first side wall 312 of the first housing 31 contacts the lower surface or radially outer end of the top plate 321. Further, the discharge port 30 is formed in the first side wall 312.

The resin section 4 will be described with reference to FIG. 2. The resin section 4 is formed using a resin material. As shown in FIG. 2, the resin section 4 has a resin filled part 41 and a resin protrusion 42. The resin protrusion 42 is a part of the flow regulating protrusion Pc.

The resin filled part 41 is filled in the housing recess 3110. As described above, the resin section 4 has the resin filled part 41. A thermoplastic resin material such as polyamide is used for the resin filled part 41, for example. Due to the configuration in which the housing recess 3110 that houses the substrate 13 and the end of the lead wire 14 on the substrate 13 side is filled with a resin material, the resin filled part 41 can cover the substrate 13 and the end of the lead wire 14 on the substrate 13 side. This makes it possible to protect the substrate 13 and the connection portion between the substrate 13 and the lead wire 14 from water, dust, and the like. Further, the resin filled part 41 can stably fix the substrate 13 and the end of the lead wire 14 on the substrate 13 side without using a fixing member different from the resin filled part 41. Moreover, the resin filled part 41 covers at least a part of the surface of the stator 12. Due to the resin filled part 41 covering or sealing the stator 12, the waterproof property and dustproof property of the stator 12 can be improved.

The resin protrusion 42 is disposed below the blades 21, protrudes upward from the resin filled part 41, and extends in the circumferential direction. As described above, the resin section 4 has the resin protrusion 42. More specifically, the resin protrusion 42 protrudes upward from the upper surface of the portion of the resin filled part 41 filled in the housing recess 3110. Due to the resin protrusion 42, air sucked from above is efficiently discharged in the circumferential direction along the resin protrusion 42. Further, even if at least a part of the housing recess 3110 formed in the bottom plate 311 of the housing 3 is at the same position as the resin protrusion 42 in the radial direction, the above-mentioned effect of smoothly delivering the airflow can also be obtained above the housing recess 3110 due to the resin protrusion 42 protruding from the resin filled part 41 filled in the housing recess 3110. Therefore, the blowing efficiency of the centrifugal fan 100 can be further improved.

For the resin protrusion 42, the same resin material as that of the resin filled part 41 is preferably used. For example, the resin protrusion 42 may be a different part of the same member as the resin filled part 41. With this configuration, the resin protrusion 42 can also be formed when the resin filled part 41 is formed. Therefore, the resin protrusion 42 can be easily formed in a smaller number of steps, and whereby the productivity of the centrifugal fan 100 is improved. However, the resin protrusion 42 is not limited to the example in the present example embodiment, and may be formed of a material different from that of the resin filled part 41.

The resin protrusion 42 is preferably disposed near the lower end of any one of the blades 21 in the radial direction. More preferably, the radially inner end of the resin protrusion 42 is located at the same position as the radially outer end of the lower end of any one of the blades 21 in the radial direction, or is located radially inward of the radially outer end of the lower end of any one of the blades 21. In this more preferable configuration, it is more preferable that the radially outer end of the resin protrusion 42 is located at the same position as the radially outer end of the base annular part 232 in the radial direction, or is located radially outward of the radially outer end of the base annular part 232. Due to the resin protrusion 42 being provided near the lower end of any one of the blades 21, the airflow can be smoothly delivered radially outward and downward from the blade 21.

The ring member 5 will be described with reference to FIG. 2. The ring member 5 has an annular shape centered on the central axis CA. As described above, the centrifugal fan 100 includes the ring member 5. The ring member 5 is axially connected to the impeller base 23, and holds the flange 1123 with the base annular part 232 of the impeller base 23 in the axial direction. Since the flange 1123 of the rotor 11 is held between the impeller base 23 and the ring member 5 in the axial direction, the impeller 2 can be rigidly fixed to the rotor 11.

The flow regulating protrusion Pc will be described with reference to FIGS. 2 to 4. FIG. 4 is a view showing the vicinity of a part of the flow regulating protrusion Pc. FIG. 4 is an enlarged top view of a portion C encircled by a broken line in FIG. 3.

The flow regulating protrusion Pc is disposed on the upper surface of the bottom plate 311 and the upper surface of the resin filled part 41. In the present example embodiment, the flow regulating protrusion Pc is a closed curve protrusion that has a closed curve shape when viewed in the axial direction, and protrudes upward from the upper surface of the bottom plate 311. Note that the flow regulating protrusion Pc is preferably disposed near the lower end of any one of the blades 21 in the radial direction. More preferably, the radially inner end of the flow regulating protrusion Pc is located at the same position as the radially outer end of the lower end of any one of the blades 21 in the radial direction, or is located radially inward of the radially outer end of the lower end of any one of the blades 21. In this more preferable configuration, it is more preferable that the radially outer end of the flow regulating protrusion Pc is located at the same position as the radially outer end of the base annular part 232 in the radial direction, or is located radially outward of the radially outer end of the base annular part 232. Due to the flow regulating protrusion Pc being provided near the lower end of any one of the blades 21, the airflow can be smoothly delivered radially outward and downward from the blade 21 near the flow regulating protrusion Pc.

In the present example embodiment, the flow regulating protrusion Pc has an annular shape centered on the central axis CA and includes the housing protrusion 315 and the resin protrusion 42. The housing protrusion 315 is a part of the flow regulating protrusion Pc, and more specifically, is a portion of the flow regulating protrusion Pc formed on the upper surface of the bottom plate 311. The resin protrusion 42 is a part of the rest of the flow regulating protrusion Pc, and more specifically, a portion of the flow regulating protrusion Pc formed on the upper surface of the resin filled part 41. Due to the flow regulating protrusion Pc having the closed curved shape, the effect of smoothly delivering the airflow over the entire circumference in the circumferential direction can be obtained.

The circumferential end of the resin protrusion 42 is connected to the circumferential end of the housing protrusion 315. For example, as shown in FIG. 4, one circumferential end of the resin protrusion 42 is connected to the other circumferential end of the housing protrusion 315. Further, the other circumferential end of the resin protrusion 42 is connected to the one circumferential end of the housing protrusion 315. With this configuration, there is no gap between the circumferential end of the resin protrusion 42 and the circumferential end of the housing protrusion 315, so that the effect of smoothly delivering the airflow radially outward and downward from the blades 21 can be further enhanced. Further, since the resin protrusion 42 and the housing protrusion 315 are connected in the circumferential direction, the strength of the resin protrusion 42 can be increased. For example, even if at least a force directed in the radial direction acts on the resin protrusion 42, the resin protrusion 42 can be rigidly fixed by the connection with the housing protrusion 315. However, the present disclosure is not limited to this example, and they may not be connected. For example, one circumferential end of the resin protrusion 42 may be in surface contact with the other circumferential end of the housing protrusion 315. In addition to or in place of the above configuration, the other circumferential end of the resin protrusion 42 may be in surface contact with one circumferential end of the housing protrusion 315.

For example, it is preferable that the resin protrusion 42 has a projection 421 and the housing protrusion 315 has a recess 3151 into which the projection 421 is engaged at the connection portion between the resin protrusion 42 and the housing protrusion 315 in the circumferential direction, as shown in FIG. 4. The projection 421 is formed on the circumferential end surface of the resin protrusion 42, and protrudes toward the housing protrusion 315. The recess 3151 is formed in the circumferential end surface of the housing protrusion 315, and protrudes in the protruding direction of the projection 421. The strength of the recess 3151 when the recess 3151 is formed in the circumferential end surface of the housing protrusion 315 is greater than that when a recess is formed in the circumferential end surface of the resin protrusion 42. Therefore, the strength of the abovementioned connection portion can be further increased.

The present disclosure is not limited to the example shown in FIG. 4. A recess may be formed in the circumferential end surface of the resin protrusion 42, and a projection to be engaged with the recess may be formed on the circumferential end surface of the housing protrusion 315. That is, on the circumferential end surface of one of the resin protrusion 42 and the housing protrusion 315, a projection projecting from the one to the other may be formed. Further, in the circumferential end surface of the other of the resin protrusion 42 and the housing protrusion 315, a recess recessed from the one to the other may be formed. Due to the engagement between the recess and the projection, the resin protrusion 42 and the housing protrusion 315 can be more rigidly connected in the circumferential direction.

The present disclosure is not limited to the abovementioned example embodiment, and the flow regulating protrusion Pc does not necessarily have a closed curve shape when viewed in the axial direction. The flow regulating protrusion Pc may have a discontinuous portion in the direction in which the flow regulating protrusion Pc extends. For example, the circumferential end surface of the resin protrusion 42 may not be in contact with the circumferential end surface of the housing protrusion 315 that circumferentially faces the circumferential end surface of the resin protrusion 42. In addition to or in place of the above configuration, at least one of the resin protrusion 42 and the housing protrusion 315 may include a plurality of protrusions extending in the circumferential direction with intervals. With this configuration, it is also possible to obtain the effect of smoothly delivering the airflow radially outward and downward from the blades 21 at the position where the flow regulating protrusion Pc is provided.

The radially outer side surface of the flow regulating protrusion Pc is preferably an inclined surface that approaches the central axis CA toward top from bottom. For example, the radially outer end surface of at least one of the resin protrusion 42 and the housing protrusion 315 may approach the central axis CA toward top from bottom. The shape of the inclined surface viewed in the circumferential direction may be linear. Alternatively, the inclined surface may have a shape protruding upward and radially outward, or a shape recessed downward and radially inward. Due to the configuration in which the radially outer end surface of the resin protrusion 42 and/or the housing protrusion 315 is the inclined surface as described above, the airflow flowing from the blades 21 easily flows downward and radially outward along the inclined surface. In addition, turbulent flow is less likely to occur radially outward of the inclined surface. Therefore, it is possible to more effectively prevent the airflow from going to the space between the blades 21 from below and radially outside of the plurality of blades 21. However, the present disclosure is not limited to this example, and the radially outer side surface of the flow regulating protrusion Pc may not be an inclined surface, and may be parallel to the axial direction, for example.

The upper end of the flow regulating protrusion Pc preferably faces the lower end of any one of the plurality of blades 21 in the axial direction. For example, the upper end of the housing protrusion 315 and the upper end of the resin protrusion 42 face the lower end of any one of the plurality of blades 21 in the axial direction. This can improve the effect of smoothly delivering the airflow radially outward and downward from the blades 21. Here, the distance Wa (see FIG. 2) in the axial direction between both the upper end of the housing protrusion 315 and the upper end of the resin protrusion 42 and the lower end of any one of the plurality of blades 21 is preferably narrower, as long as they do not contact each other. As the distance Wa between them is narrower, a leakage of the airflow can be more effectively suppressed, which enhances the abovementioned effect. However, the present disclosure is not limited to this example, and at least a part of the upper end of the flow regulating protrusion Pc may not face the lower end of any one of the plurality of blades 21 in the axial direction.

Preferably, the position of the flow regulating protrusion Pc in the radial direction is constant with respect to the central axis CA. For example, in the present example embodiment, the position of the resin protrusion 42 in the radial direction is the same as the position of the housing protrusion 315 in the radial direction. This makes it possible to uniformly obtain the abovementioned effect of smoothly delivering the airflow in the circumferential direction. However, the present disclosure is not limited to this example, and the position of the resin protrusion 42 in the radial direction may be different from the position of the housing protrusion 315 in the radial direction.

Preferably, the position of the upper end of the flow regulating protrusion Pc in the axial direction is constant. For example, when viewed in the radial direction, the upper end of the resin protrusion 42 is located at a position overlapping the upper end of the housing protrusion 315. Due to the configuration in which the position of the upper end of the resin protrusion 42 in the axial direction is set to be the same as the position of the upper end of the housing protrusion 315 in the axial direction, the abovementioned effect of smoothly delivering the airflow in the circumferential direction can be more uniformly obtained. For example, the rotational balance of the blades 21 becomes stable. However, the present disclosure is not limited to this example, and the position of the upper end of the resin protrusion 42 in the axial direction may be different from the position of the upper end of the housing protrusion 315 in the axial direction.

Preferably, the flow regulating protrusion Pc is located radially outward of the lower wall 26 of the impeller 2. More preferably, the upper end of the flow regulating protrusion Pc is located at the same position as that of the lower end of the lower wall 26 in the axial direction, or is located above the lower end of the lower wall 26. For example, the lower end of the lower wall 26 may be located radially inward of at least one protrusion out of the resin protrusion 42 and the housing protrusion 315. Further, the lower end of the lower wall 26 may be at the same position as that of the upper end of the at least one protrusion in the axial direction, or may face the at least one protrusion in the radial direction. This makes it possible to form a labyrinth structure by the lower wall 26 and the resin protrusion 42 and/or the housing protrusion 315 below the impeller base 23. Due to the labyrinth structure, air is less likely to flow radially inward between the impeller base 23 and the bottom plate 311 of the housing 3. Therefore, the blowing efficiency of the centrifugal fan 100 can be further improved.

The example embodiment of the present disclosure has been described above. Note that the scope of the present disclosure is not limited to the above example embodiment. The present disclosure can be implemented by making various modifications to the abovementioned example embodiment without departing from the gist of the disclosure. In addition, the matters described in the above example embodiment can be arbitrarily combined together, as appropriate, as long as there is no inconsistency.

The present disclosure is useful for, for example, a blower device that delivers air sucked through an intake port from a discharge port formed in a radial side surface.

Features of the above-described preferred example embodiments and the modifications thereof may be combined appropriately as long as no conflict arises.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A centrifugal fan comprising:

an impeller including a plurality of blades;

a motor including a rotor to which the impeller is attached;

a housing that houses the impeller and the motor and holds the motor; and a resin section including a resin material; wherein the plurality of blades is arranged in a circumferential direction about a central axis extending in a vertical direction;

the rotor is rotatable with the plurality of blades about the central axis;

the housing includes:

a bottom plate having a plate shape and extending in a radial direction; and a housing protrusion that is disposed below the blades, protrudes upward from an upper surface of the bottom plate, and extends in the circumferential direction;

the bottom plate is provided with a housing recess recessed downward in the upper surface; and the resin section includes:

a resin filled portion filled in the housing recess; and a resin protrusion that is disposed below the blades, protrudes upward from the resin filled portion, and extends in the circumferential direction.

2. The centrifugal fan according to claim 1, further comprising a lead wire to connect a substrate that drives the motor and an external power source, wherein the substrate and an end of the lead wire on a side of the substrate are housed in the housing recess and covered by the resin filled portion.

3. The centrifugal fan according to claim 1, wherein a circumferential end of the resin protrusion is connected to a circumferential end of the housing protrusion.

4. The centrifugal fan according to claim 3, wherein a circumferential end surface of one of the resin protrusion and the housing protrusion is provided with a projection projecting from the one to the other;

a circumferential end surface of the other of the resin protrusion and the housing protrusion is provided with a recess recessed from the one to the other; and the projection is engaged in the recess.

5. The centrifugal fan according to claim 1, wherein the bottom plate is provided with, on the upper surface, a closed curve protrusion that protrudes upward and that has a closed curve shape as viewed in the axial direction; and the housing protrusion defines a first portion of the closed curve protrusion, and the resin protrusion defines a second portion of the closed curve protrusion.

6. The centrifugal fan according to claim 1, wherein a radially outer end surface of at least one of the resin protrusion and the housing protrusion approaches the central axis from bottom toward top.

7. The centrifugal fan according to claim 1, wherein an upper end of the housing protrusion and an upper end of the resin protrusion face a lower end of any one of the plurality of blades in an axial direction.

8. The centrifugal fan according to claim 1, wherein the impeller includes a base annular portion that has an annular shape and is centered on the central axis;

lower ends of the blades are connected to the base annular portion; and the resin protrusion and the housing protrusion are disposed at a same position as a radially outer end of the base annular portion in the radial direction, or disposed radially outward of the radially outer end of the base annular portion.

9. The centrifugal fan according to claim 1, wherein an upper end of the resin protrusion is disposed at a position overlapping an upper end of the housing protrusion as viewed in the radial direction.

10. The centrifugal fan according to claim 1, wherein the impeller includes an impeller base that has an annular shape and is centered on the central axis;

lower ends of the blades are connected to an upper surface of the impeller base;

the impeller base includes, on a lower surface, a lower wall protruding downward and extending in the circumferential direction;

a lower end of the lower wall is located radially inward of at least one protrusion out of the resin protrusion and the housing protrusion; and the lower end of the lower wall is located at a same position as a position of the upper end of the at least one protrusion in the axial direction or faces the at least one protrusion in the radial direction.

* * * * *